US010920965B2

(12) United States Patent
Jarvis

(10) Patent No.: US 10,920,965 B2
(45) Date of Patent: Feb. 16, 2021

(54) UTILITY DROP LIGHT WITH AUTOMATIC SHIELDING LIGHT TUBE

(71) Applicant: David Jarvis, Newburgh, IN (US)

(72) Inventor: David Jarvis, Newburgh, IN (US)

( * ) Notice: Subject to any disclaimer, the term of this patent is extended or adjusted under 35 U.S.C. 154(b) by 0 days.

(21) Appl. No.: 16/654,893

(22) Filed: Oct. 16, 2019

(65) Prior Publication Data

US 2020/0116333 A1 Apr. 16, 2020

Related U.S. Application Data

(60) Provisional application No. 62/746,230, filed on Oct. 16, 2018.

(51) Int. Cl.

| | |
|---|---|
| ***F21L 4/00*** | (2006.01) |
| ***F21V 14/04*** | (2006.01) |
| ***F21L 4/02*** | (2006.01) |
| *F21W 131/10* | (2006.01) |
| *F21Y 103/10* | (2016.01) |

(52) U.S. Cl.

CPC ..... *F21V 14/045* (2013.01); *F21L 4/027* (2013.01); *F21W 2131/1005* (2013.01); *F21Y 2103/10* (2016.08)

(58) Field of Classification Search

CPC ..... F21V 14/04; F21V 21/145; F21V 7/005; F21L 14/02; F21S 6/003; H01J 61/34

USPC ..... 362/119, 114, 187, 198, 199, 296.01

See application file for complete search history.

(56) References Cited

U.S. PATENT DOCUMENTS

| | | | | |
|---|---|---|---|---|
| 1,692,892 | A * | 11/1928 | Floyd | F21L 14/00 362/378 |
| 4,924,365 | A | 5/1990 | Bogdanovs | |
| 5,408,389 | A | 4/1995 | Burlingame | |
| 5,436,815 | A | 7/1995 | Grooms et al. | |
| 5,765,941 | A * | 6/1998 | Vest | F21L 14/026 313/50 |
| 5,911,498 | A | 6/1999 | Shemitz et al. | |
| 6,857,756 | B2 | 2/2005 | Reiff et al. | |
| 6,979,100 | B2 | 12/2005 | Reiff et al. | |
| 7,229,185 | B1 | 6/2007 | Galvez et al. | |
| 7,270,443 | B2 | 9/2007 | Kurtz et al. | |
| 7,648,261 | B2 | 1/2010 | Ko et al. | |
| 7,731,386 | B2 | 6/2010 | Levine | |
| 7,841,735 | B2 | 11/2010 | Newton et al. | |
| 8,033,681 | B2 | 10/2011 | Brass et al. | |
| D701,986 | S | 4/2014 | Goeckel | |
| 9,091,401 | B2 | 7/2015 | Wong et al. | |

(Continued)

*Primary Examiner* — William J Carter
*Assistant Examiner* — Omar Rojas Cadima
(74) *Attorney, Agent, or Firm* — Martin IP Law Group; C. Richard Martin

(57) ABSTRACT

A utility drop light having a shield for directing light in a particular direction and preventing the light from shining in the user's eyes is provided according to the invention. The utility drop light includes a translucent light tube having a first end and a second end, a light source positioned within the translucent light tube between the first and second ends thereof, and a light shield extending from the first end of the translucent light tube to the second end of the translucent light tube. The light shield is positioned between the translucent light tube and the light source. The light shield is rotatable relative to the light tube and is weighted such that the light shield is always positioned above the light source relative to the earth.

17 Claims, 5 Drawing Sheets

(56) References Cited

U.S. PATENT DOCUMENTS

| | | | | |
|---|---|---|---|---|
| 9,360,195 | B2 * | 6/2016 | Goeckel | F21V 7/00 |
| 9,713,216 | B2 | 7/2017 | Urry et al. | |
| 9,746,143 | B2 | 8/2017 | Osburn | |

* cited by examiner

UTILITY DROP LIGHT WITH AUTOMATIC SHIELDING LIGHT TUBE

BACKGROUND OF THE INVENTION

Field of the Invention

The present invention relates to utility drop lights. More specifically, the present invention relates to utility drop lights having a shield for directing light in a particular direction and preventing the light from shining in the user's eyes.

Description of the Related Art

Utility drop lights are used to illuminate obscure places and are generally able to handle moderate abuse. The light bulb is housed in a protective cage and a handle that are molded to form a single unit. Drop lights have traditionally included a long power cord that can be plugged into an AC wall outlet, or powered by a 12-volt source, such as a car battery. The bulb of the utility drop light typically has a heavy filament to withstand dropping. Newer models often use LED arrays as the light source, which also allows the light to be powered by an internal battery, removing the need for a cord to connect to AC power.

Drop lights are often used by automotive mechanics and electricians where localized light is needed where ambient light proves to be insufficient. A problem that occurs regularly during such use is that the orientation of the drop light changes due to some external source and the light is redirected into the eyes of the mechanic or electrician rather than on the work. The shield that is used to direct the light toward the work and keep it out of the eyes of the mechanic or electrician is generally fixed relative to the light source so that when the light source pivots, so does the shield thereby directing the light away from the work and possibly into the eyes of the mechanic or electrician.

Accordingly, there is a need for a utility drop light where the shield remains steady relative to the work environment even when the portion and/or orientation of the light changes. There is a need for a utility drop light where the shield automatically faces in a particular direction regardless of the orientation of the light itself.

SUMMARY OF THE INVENTION

It is therefore an object of the present invention to provide a utility drop light where the light is automatically directed toward the work and away from the eyes of the user.

It is also an object of the invention to provide a utility drop light having a shield that automatically positions itself between the user and the work to prevent the light from shining into the user's eyes.

The present invention meets these objects by providing a utility drop light where the light source is always oriented toward the ground and away from the eyes of the user. This is accomplished by weighting the side of an inner cylinder opposite to the shield such that that shield is always on top directing light downwardly toward the ground.

According to one presently preferred embodiment of the invention, there is provided a utility drop light comprising a translucent light tube having a first end and a second end, a light source positioned within the translucent light tube between the first and second ends thereof, and a light shield extending from the first end of the translucent light tube to the second end of the translucent light tube and positioned between the translucent light tube and the light source, which is rotatable relative to the light tube and weighted such that the light shield is always positioned above the light source relative to the earth.

The light shield may be arc-shaped. The light shield may be affixed to a second, inner light tube having first and second ends aligned with the first and second ends of the translucent light tube respectively, and further comprising weights attached to a surface of the light tube that is diametrically opposing the light shield. The inner light tube may be translucent, or it may include an open area in the tube diametrically opposing the light shield allowing light from the light source to pass through the inner light tube. The weights may be attached at the first and second ends of the inner light tube. The inner surface of the light shield may be reflective.

First and second rolling-element bearings may be located between the translucent light tube and the light shield and positioned at the first and second ends thereof, respectively. Each of the first and second rolling-element bearings may include an outer race member that is affixed to an inner surface of the translucent light tube and an inner race member that is affixed to an outer surface of the light shield, and a plurality of ball bearings located between the inner and outer race members which allow the light shield to rotate freely relative to the translucent light tube.

A first closed end cap member may be attached to the first end of the translucent light tube, and a second end cap member may be attached to a second end of the translucent light tube. The second end cap member may have a central opening therein for receiving the light source.

An illumination assembly which includes the light source and a handle assembly attached to a first end of said light source at a collar may also be provided. The illumination assembly collar may engage the opening in the second end cap member such that the light source is positioned inside the translucent light tube and the handle is position outside said translucent light tube.

According to an alternative preferred embodiment of the invention, there is provided a utility drop light comprising a translucent light tube having a first end and a second end, a light source positioned within the translucent light tube between the first and second ends thereof; and means for automatically directing light emitted from the light source in a direction downward toward the earth.

The light source according to this embodiment may comprise a flat bar having an upper surface and a lower surface. The lower surface may include one or more lights that project light in a single direction. The means for automatically directing light may comprise one or more weights positioned on the lower surface of the flat bar of the light source and a rolling-element bearing located between the translucent light tube and the light source to permit free rotation of the light source relative to the translucent light tube. The one or more lights may be light emitting diodes.

The rolling-element bearing may include an outer race member that is affixed to an inner surface of the translucent light tube and an inner race member that is affixed to an outer surface of the light source, and a plurality of ball bearings located between the inner and outer race members which allow the light source to rotate freely relative to the translucent light tube. A first closed end cap member attached to the first end of the translucent light tube, and a second end cap member attached to a second end of the translucent light tube may also be provided. The second end cap member may include a central opening therein for receiving the light source.

An illumination assembly may be provided which includes the light source and a handle assembly attached to a first end of the light source at a collar. The illumination assembly collar may engage the opening in the second end cap member such that the light source is positioned inside the translucent light tube and the handle is position outside the translucent light tube.

The means for automatically directing light may comprise a light shield extending from the first end of the translucent light tube to the second end of the translucent light tube and positioned between the translucent light tube and the light source. The light shield may be affixed to a second, inner light tube having first and second ends aligned with the first and second ends of the translucent light tube respectively. Weights may also be attached to a surface of the light tube that is diametrically opposing the light shield.

First and second rolling-element bearings may be provided and located between the translucent light tube and the light shield positioned at the first and second ends thereof, respectively.

These and other objects, features and advantages of the present invention will become apparent from a review of the following drawings and detailed description of the preferred embodiments of the invention.

BRIEF DESCRIPTION OF THE DRAWINGS

The present invention can best be understood in connection with the accompanying drawings. It is noted that the invention is not limited to the precise embodiments shown in the drawings, in which.

DETAILED DESCRIPTION OF THE INVENTION

Figure 1:
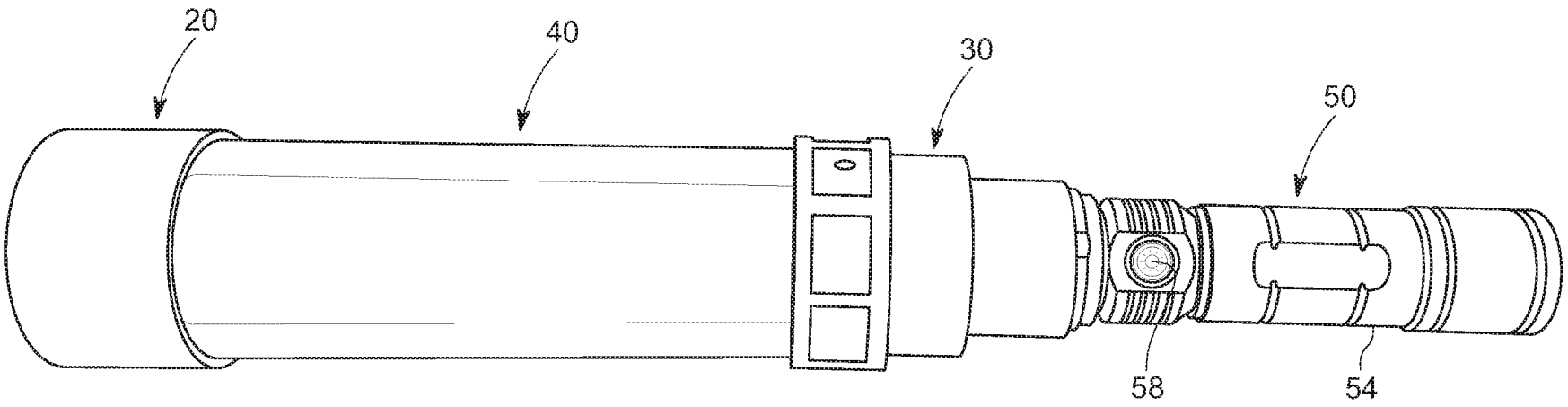
FIG. 1 is a front plan view of a utility drop light with automatic rotating shield according to a preferred embodiment of the present invention.

For purposes of promoting and understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention that would normally occur to one skilled in the art to which the invention relates.

Figure 2:
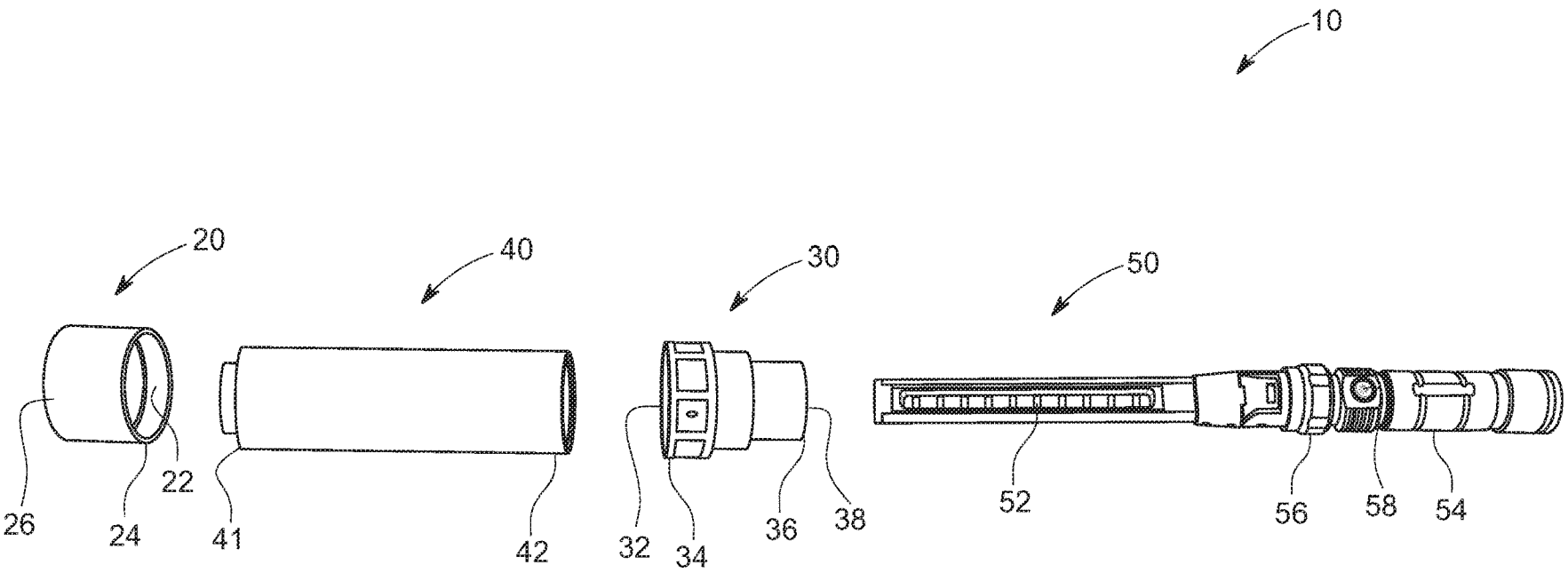
FIG. 2 is a exploded view of the utility drop light shown in FIG. 1.

As best shown in FIG. 1 and FIG. 2, one presently preferred embodiment of the invention comprises a utility drop light 10 having a first end member 20, a second end member 30 and an automatic shielding light tube 40 positioned there-between. The first end member 20 has an opening 22 in a first end 24 thereof sized to receive a first end 41 of the light tube 40, and the second end 26 of the first end member 20 is preferably closed such that the first end member 20 forms an end cap for the utility drop light 10. The second end member 30 has an opening 32 in a first end 34 thereof sized to receive a second end 42 of the light tube 40, and the second end 36 of the second end member 30 has a second opening 38 that is sized to receive the illumination assembly 50 such that a light source 52 is positioned within the light tube 40 between the first end member 20 and second end member 30.

Figure 3:
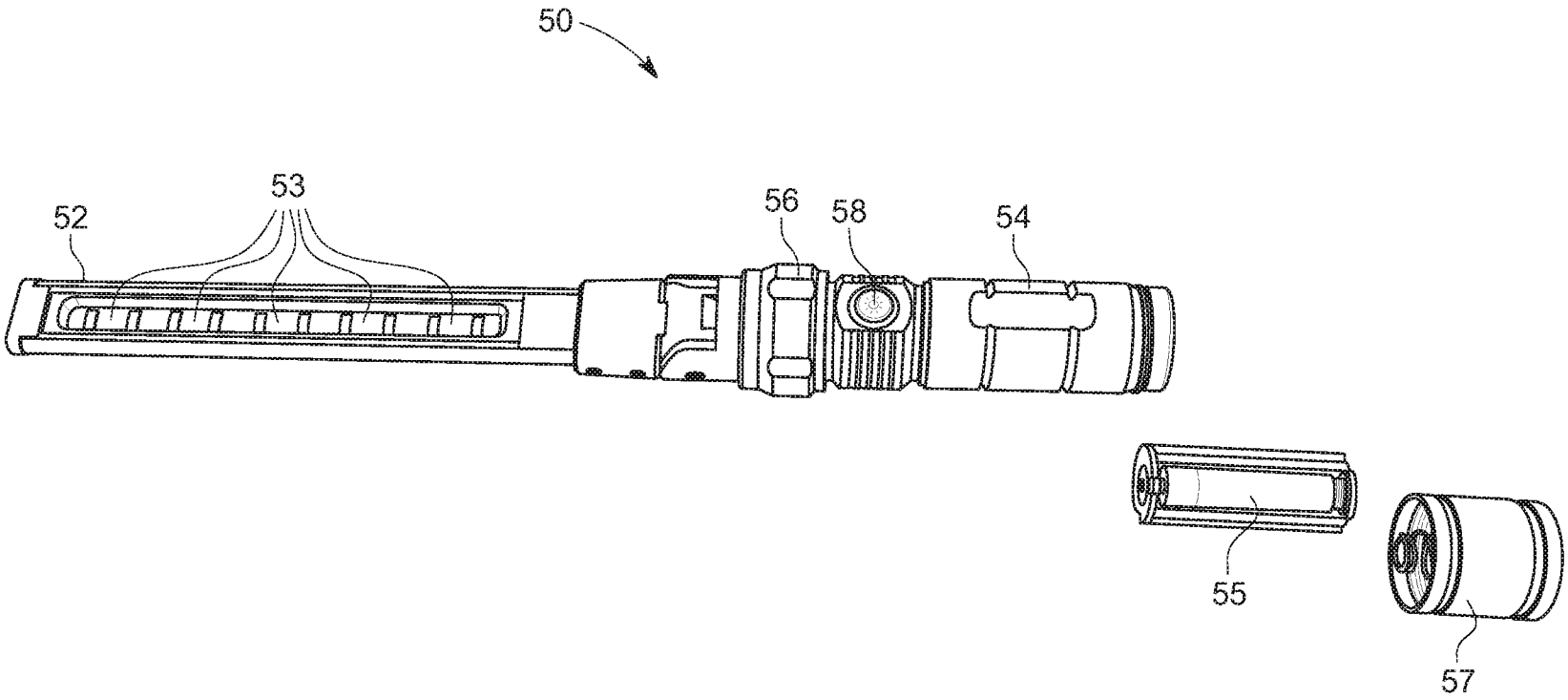
FIG. 3 is an exploded view of the illumination assembly of the utility drop light shown in FIG. 1 and FIG. 2.

The illumination assembly 50 includes a light source 52 and handle 54 with a collar 56 positioned there-between. As shown in FIG. 3, the light source 52 preferably consists of a plurality of light emitting diodes (LEDs) 53 that project light in a single direction. However, other lighting configurations that project light in a single direction or in all directions or anything in between are contemplated. The collar 56 is sized to fit into and frictionally engage the opening 38 in the second end 36 of the second end member 30. The handle 54 is configured to be gripped by a user's hand and may include a power switch or button 58 for turning the light source 52 on and off. A power source is provided for the LEDs 53. As shown in FIG. 3, the power source may consist of a battery pack 55 that is inserted into a hollow opening inside the handle 54 and held in place by end cap 57. Alternatively, a power cord could connect the handle 54 to a source of either direct or alternating current.

Figure 4:
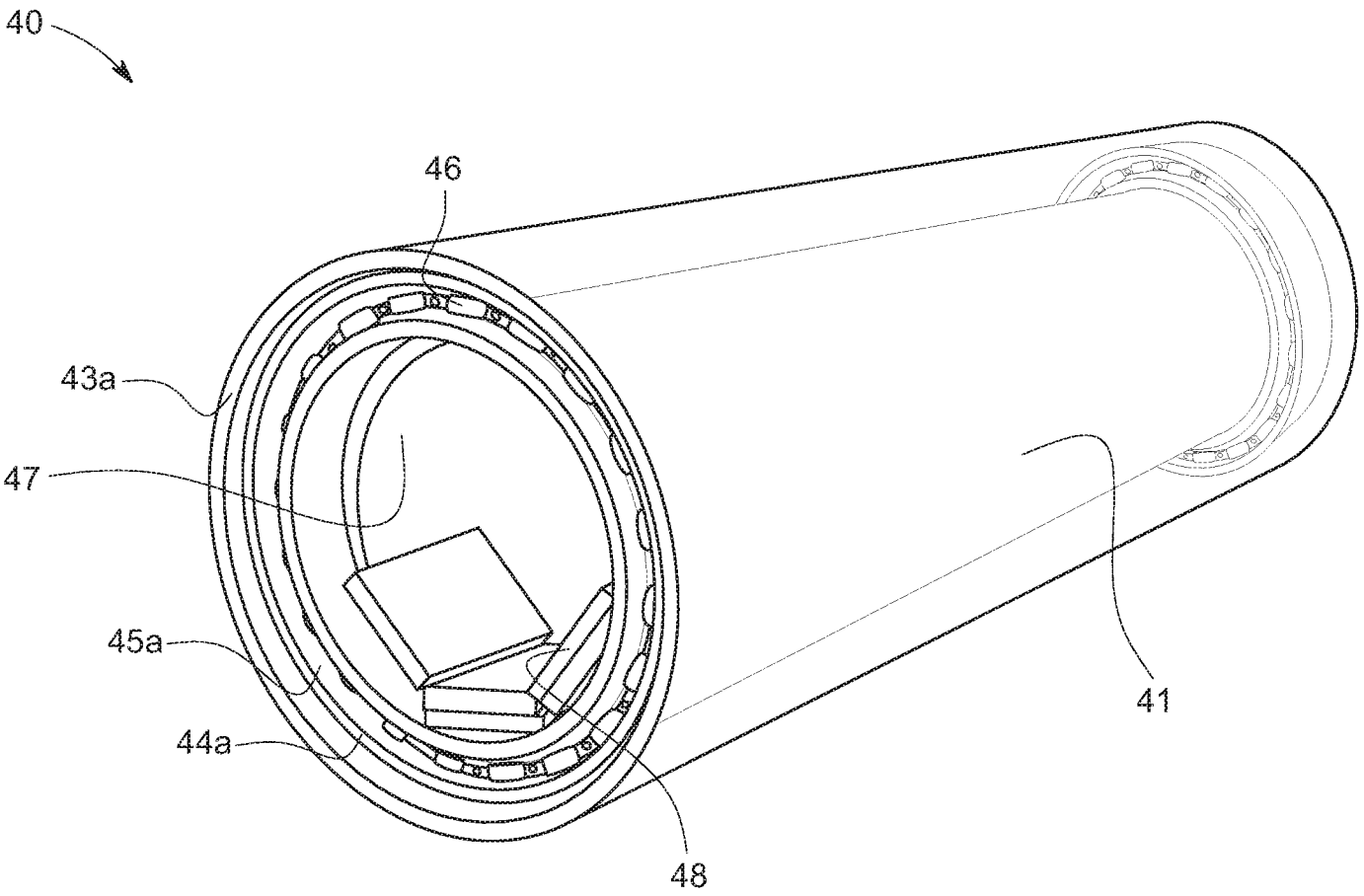
FIG. 4 is a perspective view of the light tube of the utility drop light shown in FIG. 1 and FIG. 2.
Figure 5:
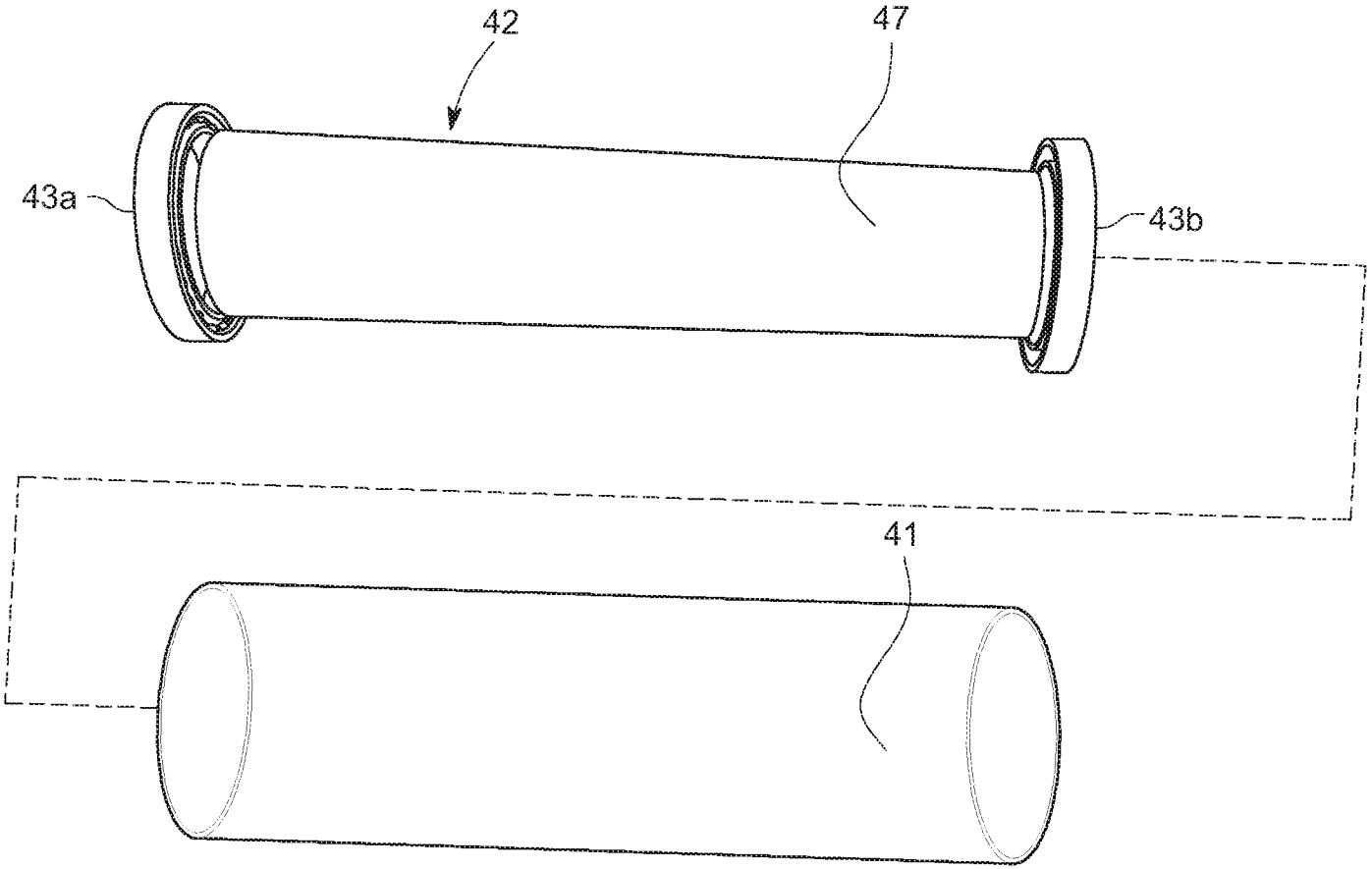
FIG. 5 is an exploded view of the light tube shown in FIG. 4.

The light tube 40 is constructed such that the light from the light source 52 is always directed downwardly, thus avoiding the light shining in the user's eyes when the utility drop light 10 rotates or changes position. As best shown in FIG. 4 and FIG. 5, the light tube 40 includes an outer cylinder 41 and an inner cylinder 42 separated by a pair of rolling bearings 43*a*, 43*b*. The outer race 44*a*, 44*b* of each rolling bearing 43*a*, 43*b* is attached to the outer cylinder 41 and the inner race 45*a*, 45*b* of each rolling bearing 43*a*, 43*b* is attached to the inner cylinder 42 so that the outer cylinder 41 rotates relatively freely on the ball bearings 46 relative to the inner cylinder 42.

The outer cylinder 41 is formed of a clear material such as translucent glass or plastic that lets light emitted from the light source 52 pass through to illuminate the object on which the user is focused. At least a portion of the inner cylinder 42 includes a solid surface shield 47 to prevent light emitted from the light source to pass through. The remaining portion of the inner cylinder 42 is configured to allow light emitted from the light source 52 to freely pass there-through. This could take the form of an open area in the cylinder or a clear material such as translucent glass or plastic. Preferably, the inner surface of the shield 47 is provided with a reflective material to better illuminate the target object. One or more weights 48 are provided on the surface of the inner cylinder 42 directly opposite the shield 47. A sufficient number of weights 48 are provided to ensure that the weight of that side of the inner cylinder 41 is heavy enough that it is always oriented closest to the ground when the utility drop light 10 is held in a substantially horizontal position. The result of the weights 48 being oriented closest to the ground is that the shield 47 on the opposing side of the inner cylinder 42 is always located above the light source 52 directing the light source downwardly and away from the eyes of the user.

Where the light source 52 is a bar with LED lights shining in a single direction as shown in the drawings, it is also possible, and within the scope of the present invention, to couple the light source 52 directly to the inner races 45*a*, 45*b* and place the weights 48 on the lighted side of the bar so that the lighted face of the light bar always faces down. Separate weights 48 are not required so long as the lighted side (or non-shielded side of the inner cylinder 42) is heavier than the other side such that, by force of gravity orients itself nearest the ground.

A mechanism such as a thumbscrew or pin may be used to lock the shield 47 in place to prevent rotation. In addition, a hook or wire may be wrapped around the exterior of the utility drop light 10 to hang the light from a location such as the hood of a vehicle so the mechanic's hands are free to work on the vehicle.

This detailed description, and particularly the specific details of the exemplary embodiment disclosed, is given primarily for clearness of understanding and no unnecessary limitations are to be understood therefrom, for modifications will become evident to those skilled in the art upon reading this disclosure and may be made without departing from the spirit or scope of the claimed invention.

I claim:

1. A utility drop light comprising:

an outer translucent light tube having a first end and a second end;

an inner translucent light tube having first and second ends aligned with the first and second ends of the outer translucent light tube respectively;

a light source positioned within the inner translucent light tube between said first and second ends thereof; and a light shield affixed to and extending from the first end of the inner translucent light tube to the second end of the inner translucent light tube and positioned between said outer translucent light tube and said light source; said light shield being rotatable relative to said outer translucent light tube and being weighted such that the light shield is always positioned above the light source relative to the earth.

2. The utility drop light of claim 1, wherein the light shield is arc-shaped.

3. The utility drop light of claim 2, wherein weights are attached at the first and second ends of the inner light tube.

4. The utility drop light of claim 2, wherein the inner surface of the light shield is reflective.

5. The utility drop light of claim 1, further comprising first and second rolling-element bearings located between the outer translucent light tube and said light shield and positioned at said first and second ends thereof, respectively.

6. The utility drop light of claim 5, wherein each of the first and second rolling-element bearings includes an outer race member that is affixed to an inner surface of the outer translucent light tube and an inner race member that is affixed to an outer surface of the light shield, and a plurality of ball bearings located between the inner and outer race members which allow the light shield to rotate freely relative to the outer translucent light tube.

7. The utility drop light of claim 5, further comprising a first closed end cap member attached to the first end of said outer translucent light tube, and a second end cap member attached to a second end of said outer translucent light tube, said second end cap member having a central opening therein for receiving said light source.

8. The utility drop light of claim 7, further comprising an illumination assembly which includes said light source and a handle assembly attached to a first end of said light source at a collar, said illumination assembly collar engaging the opening in the second end cap member such that the light source is positioned inside the outer translucent light tube and the handle is positioned outside said outer translucent light tube.

9. A utility drop light comprising:

a translucent light tube having a first end and a second end;

a light source positioned within the translucent light tube between said first and second ends thereof, said light source having a first surface with one or more lights that project light in a single direction, and said light source being rotatable relative to the translucent light tube; and one or more weights positioned on said first surface of the light source for automatically directing light emitted from said light source in a direction downward toward the earth.

10. The utility drop light of claim 9, wherein said light source comprises a flat bar having an upper surface and a lower surface, said one or more lights positioned on the lower surface of the flat bar; and said one or more weights are positioned on the lower surface of said flat bar of the light source and further comprising a rolling-element bearing located between the translucent light tube and said light source to permit free rotation of the light source relative to the translucent light tube.

11. The utility drop light of claim 10, wherein said one or more lights are light emitting diodes.

12. The utility drop light of claim 10, wherein said rolling-element bearing includes an outer race member that is affixed to an inner surface of the translucent light tube and an inner race member that is affixed to an outer surface of the light source, and a plurality of ball bearings located between the inner and outer race members which allow the light source to rotate freely relative to the translucent light tube.

13. The utility drop light of claim 12, further comprising a first closed end cap member attached to the first end of said translucent light tube, and a second end cap member attached to a second end of said translucent light tube, said second end cap member having a central opening therein for receiving said light source.

14. The utility drop light of claim 13, further comprising an illumination assembly which includes said light source and a handle assembly attached to a first end of said light source at a collar, said illumination assembly collar engaging the opening in the second end cap member such that the light source is positioned inside the translucent light tube and the handle is position outside said translucent light tube.

15. The utility drop light of claim 9, further comprising a light shield extending from the first end of the translucent light tube to the second end of the translucent light tube and positioned between said translucent light tube and said light source.

16. The utility drop light of claim 15, wherein the light shield is affixed to a second, inner light tube having first and second ends aligned with the first and second ends of the translucent light tube respectively, and further comprising weights attached to a surface of the light tube that is diametrically opposing the light shield.

17. The utility drop light of claim 16, further comprising first and second rolling-element bearings located between the translucent light tube and said light shield and positioned at said first and second ends thereof, respectively.

* * * * *